United States Patent [19]

Kobler et al.

[11] Patent Number: 4,754,959

[45] Date of Patent: Jul. 5, 1988

[54] FOLDING APPARATUS FOR TRANSVERSE FOLDING AND TRANSPORTING OF TWO TYPES OF PRINTED SUBSTRATES

[75] Inventors: Ingo Kobler, Anhausen; Eckhard Schneider, Stadtbergen, both of Fed. Rep. of Germany

[73] Assignee: M.A.N. Roland Druckmaschinen Aktiengesellschaft, Augsburg, Fed. Rep. of Germany

[21] Appl. No.: 892,713

[22] Filed: Jul. 31, 1986

[30] Foreign Application Priority Data

Aug. 2, 1985 [DE] Fed. Rep. of Germany ..... 3527710
Aug. 2, 1985 [DE] Fed. Rep. of Germany ..... 3527713

[51] Int. Cl.[4] ..... B41F 13/56

[52] U.S. Cl. ..... 270/21.1; 270/57; 493/324

[58] Field of Search ..... 270/1.1, 5–9, 270/21.1, 20.1, 45, 55, 57, 58; 493/324

[56] References Cited

U.S. PATENT DOCUMENTS

| | | | |
|---|---|---|---|
| 2,463,769 | 3/1949 | Higgens | 270/21.1 |
| 3,417,987 | 12/1968 | Hannon et al. | 270/45 |
| 3,762,697 | 10/1973 | Schunemann | 270/6 |
| 3,784,187 | 1/1974 | Takayanagi | 270/6 X |
| 3,877,692 | 4/1975 | Kluge et al. | 270/57 X |
| 3,889,939 | 6/1975 | Faltin | 270/21.1 |
| 3,942,782 | 3/1976 | Hermach | 270/21.1 X |
| 3,999,454 | 12/1976 | Tiso et al. | 270/21.1 |
| 4,279,410 | 7/1982 | Schunemann | 270/6 |
| 4,368,879 | 1/1983 | Hoshi | 270/6 |
| 4,564,470 | 1/1986 | Schmitt | 270/21.1 |

FOREIGN PATENT DOCUMENTS

| | | | |
|---|---|---|---|
| 3126279 | 1/1983 | Fed. Rep. of Germany | 270/21.1 |
| 2455513 | 1/1981 | France | 270/21.1 |
| 437858 | 11/1935 | United Kingdom | 270/6 |

*Primary Examiner*—E. H. Eickholt
*Attorney, Agent, or Firm*—Frishauf, Holtz, Goodman & Woodward

[57] ABSTRACT

To provide, selectively, different outputs from a cutting and folding apparatus (FIGS. 3, 4, 5), first and second cutting and folding groups (11, 12, 13; 608, 609, 610, 611; 14, 15, 13; 621, 622, 623) provide, respectively, first and second types of printed substrates (A1, A2), for example forming advertising material for men's wear and ladies' wear, for subsequent insertion into a newspaper, the respective first and second cutting and folding apparatus delivering the printed substrates which may have undergone one longitudinal fold, and have been transversely folded by the cutting and folding apparatus to transport belts, which, further and selectively, either transport the two different types of cut and folded substrates to separate receiving stations (21, 22) which may form further longitudinal folds therein, or, in dependence on a setting of a switch (16, 16'; 26, 611), supply the two types of printed subject matter to one further receiving station (22; 614) and associate the two types of substrates (A1, A2) by an alignment apparatus providing different path lengths for the respective substrates, so that the leading edges thereof are in alignment and match, for ready and automatic insertion into a newspaper.

20 Claims, 3 Drawing Sheets

601
618
2
604
605
603
601a
601b
606
70
611
611'
A1
616
617
615
612
613
610
610'
608''
608'
609
608
614
614c
614b
614a
A2
650
624
625
622a
623
622
621
119
120
603b
626
602b

FOLDING APPARATUS FOR TRANSVERSE FOLDING AND TRANSPORTING OF TWO TYPES OF PRINTED SUBSTRATES

Reference to related application, assigned to the assignee of the present invention, the disclosure of which is hereby incorporated by reference: U.S. Ser. No. 892,712, filed July 31, 1986, now U.S. Pat. No. 4,720,091, KOBLER.

The present invention relates to folding apparatus for transverse folding of printed substrates which, typically, have been cut from a continuously supplied web, and more particularly to such apparatus which permits selective use thereof so that various types of folds and interleaving of folded printed substrates can be assembled together. A typical application is the preparation of advertising inserts for newspapers in which, for example, one type of advertising insert carries advertising for ladies' wear, another type of insert carries advertising for men's wear, both of which inserts are to be folded and selectively assembled, or provided for separate outputs, all automatically, to eliminate manual insertion of the inserts into a newspaper.

BACKGROUND

Newspaper presses usually provide newsprint and/or advertising material in form of a continuous web which receives a first fold by being passed over a folding triangle or folding former. The web, selectively, may be cut along the central or fold lines resulting in two continuous web sections. Selectively, the web sections can be folded together in a subsequent rotary folding apparatus which also severs the continuous web into discrete lengths. The second fold forms the first transverse fold. The two sections, if they are kept together, may then be folded once more, for example also by a rotary or reciprocating folding apparatus, which provides a third fold, forming either a second transverse fold or a second longitudinal fold. If the two sections were kept together, severed or not, the types of printed subject matter on either section will be interleaved or interlaced. The printed insert, thus, may carry pages of advertising of ladies' wear, double the number of pages of men's wear, and again pages of ladies' wear. If, for distribution reasons, it is desired to provide inserts which show only men's wear, or only ladies' wear, or two separate inserts so that respectively interested readers can separate out the sections, the handling of the material becomes difficult.

Is is, thus, frequently desirable to insert printed subject matter of different types, for example advertising for ladies' wear and for men's wear, loosely folded, to to be inserted, together, into a newspaper. In the past, it was necessary to separately print the respective types of inserts and fold them by the respective folding apparatus to receive two different types of folded, prepared printed substrates which, then, by subsequent handling, were interlaced and inserted into a newspaper. To do so is complex and time consuming

THE INVENTION

It is an object to provide an arrangement in which, selectively, printed subject matter is collected in advance of the third folds—which may be a longitudinal or transverse fold—or which permits double production, that is, separation of the respective types of printed substrates, preferably in advance of the third folding step. Thus, different types of substrates may be transported, selectively, to a third folding cylinder, or to a receiving station. In another mode of operation, already transversely folded printed products of different types, for example advertising for ladies' wear and men's wear, are, handled in such a way that the final product, selectively, will be either both types of printed substrates folded within each other or adjacent each other so that they can be inserted in a single insertion step into a newspaper, magazine, or other printed product.

Briefly, a first cutting and folding unit is located to receive a first type of printed web, for example carrying advertisement for ladies' wear, cutting the web and folding the cut web transversely to form a first transverse fold of a cut, printed substrate; a second cutting and folding unit is located to receive a second type of printed web, for example carrying advertisements for men's wear, cutting the web and folding the cut web transversely to form a second transverse fold of a cut, printed substrates. Transport elements are provided for moving the cut substrate from the respective first and second cutting units. The first and second cutting units are arranged to supply the printed substrate to the transport in pairs, and spaced from each other—in the direction of movement of the transport. In accordance with a feature of the invention, and in dependence on the desired final arrangement of the products, an alignment apparatus is provided receiving the two types of cut substrates from the respective first and second cutting and folding units and so controlling the relative movement of the cut and folded substrates of the two types being delivered by the transport unit to the receiving station so that the folded edges will be superimposed and in alignment, in order to provide two superimposed insert elements, ready for insertion into a newspaper, magazine or the like; or, selectively, switching the printed substrates of the respective first and second type to a first and second receiving station, for example for further folding, so that they can be handled and inserted separately, for example into newspapers intended for different distribution, or for different handling, or for different readerships, for example.

The arrangement has the advantage of substantial versatility; thus, the folding apparatus for example includes a folding blade—folding flap cylinder forming a first transverse fold and a transport apparatus to carry the once transversely folded substrates to a second transverse fold, or, selectively, to permit folded substrates which have been transversely folded at least once to be so handled that the final product, selectively, of the two types of substrates are folded within each other for direct insertion into a newspaper or other printed product.

DRAWINGS

Figure 5:
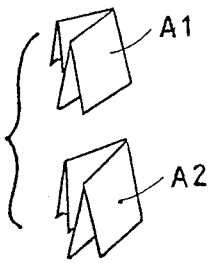
FIGS. 3, 4 and 5 illustrate, respectively, different types of folded products obtainable from the apparatus of FIGS. 1 or 2.
Figure 4:
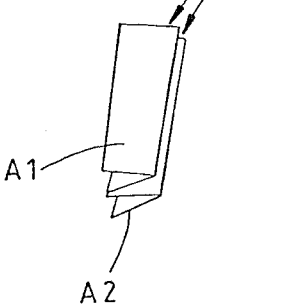
Figure 3:
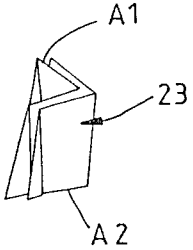
Figures 6, 7, 8, 9:
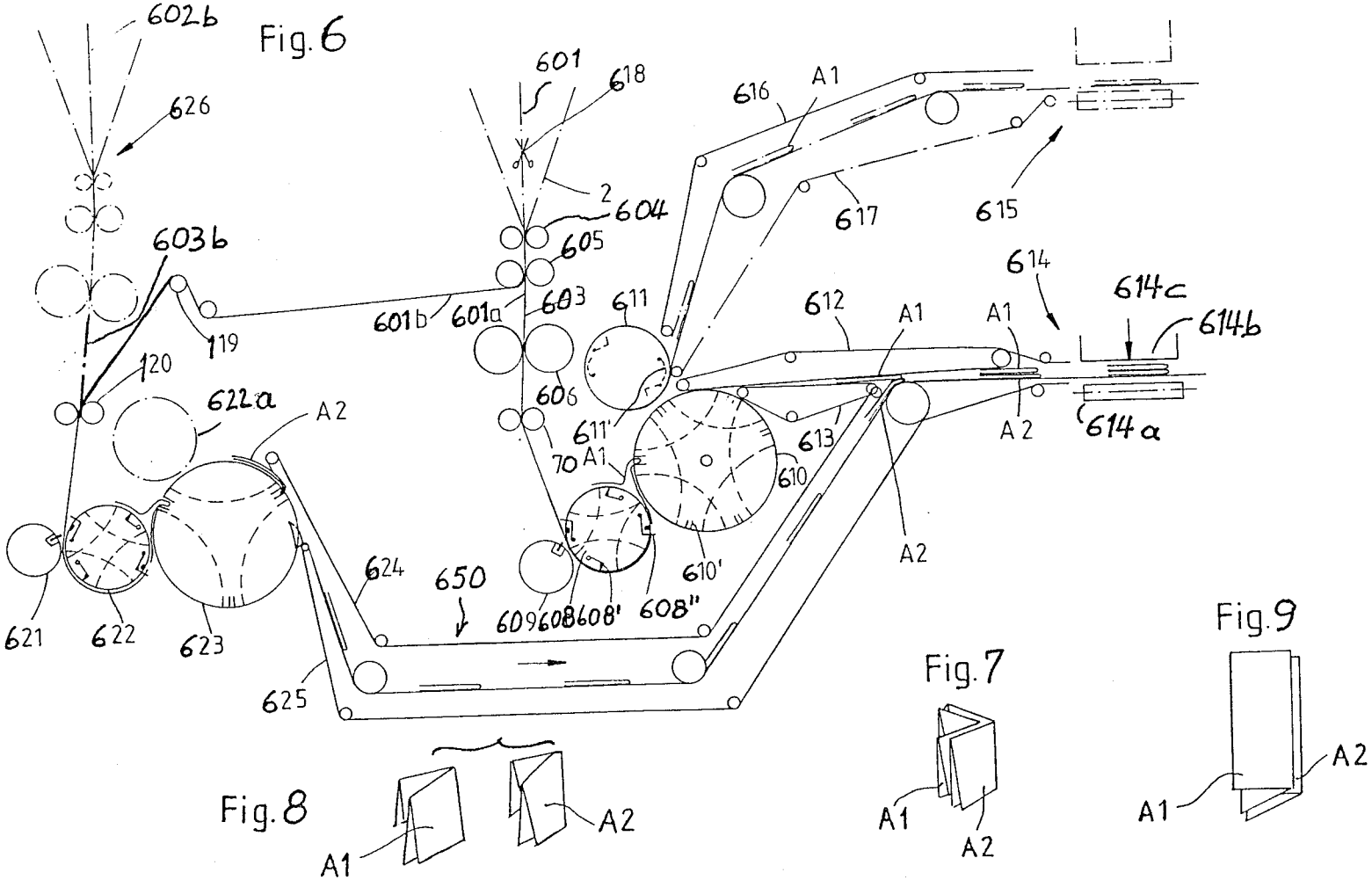

FIG. 6, schematically, illustrates an arrangement in which the travel of the respective types of folded substrate is different; and FIGS. 7, 8, and 9 are identical to FIGS. 3, 4 and 5 and reproduced together with FIG. 6 for ease of visualization.

DETAILED DESCRIPTION

Figure 1:
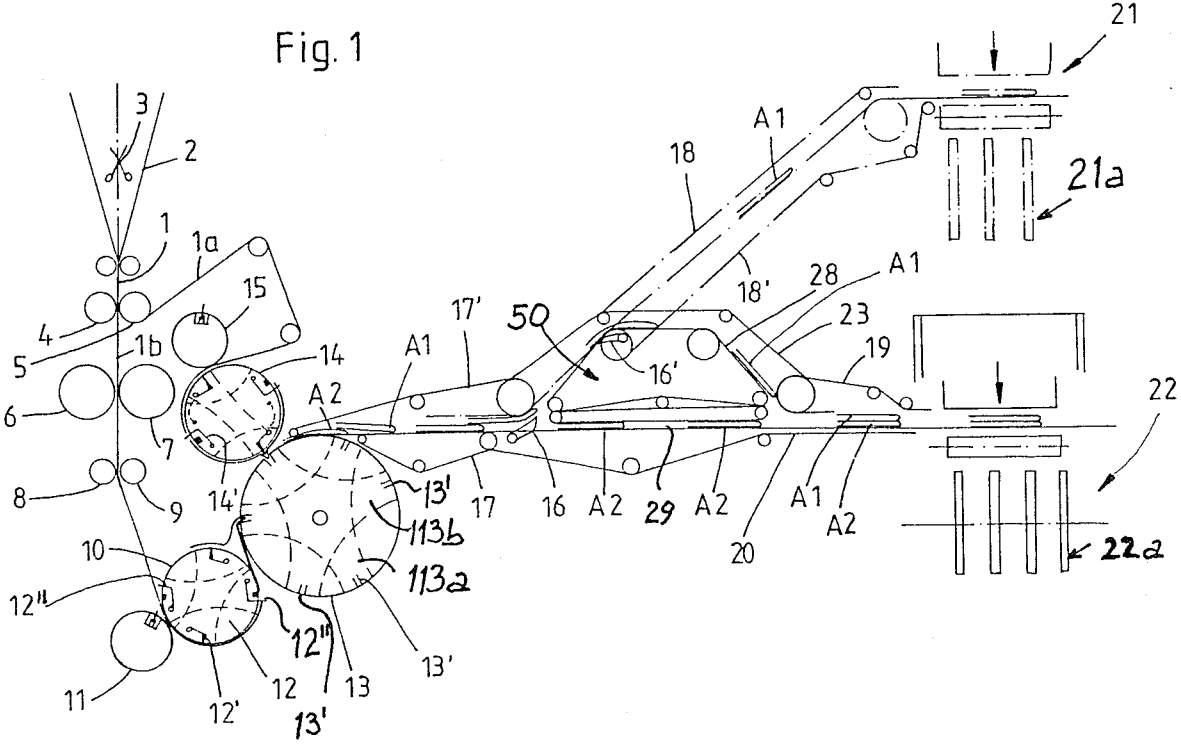
FIG. 1 is a schematic illustration of an apparatus in accordance with the invention and illustrating one type of a collecting station.

Referring first to the schematic representation of FIG. 1:

A continuous web 1 received, for example, from a continuous web printing machine is passed over a folding triangle or former 2. The web 1 is longitudinally cut along the fold lines as schematically shown by the scissor representation 3. The cutting apparatus may be in accordance with any well known and customary cutter, for example a rotating cutter wheel, cutting the web at the apex of the former. The webs are pulled off the former by pulling rollers 4, 5 which, also, separate the now cut web 1 into two web sections 1*a* and 1*b*. The web section 1*b* is passed through a perforating apparatus, formed by perforating cylinders 6, 7 and, after being pulled along by further pulling rollers 8, 9, web 1*b* is cut transversely by cutter cylinder 11, resulting in the first type of printed substrates A1, each having a predetermined desired length. All the apparatus used so far is standard and may be construed with any conventional equipment.

The folding blade cylinder 12, which also functions as a counter cylinder to cutter cylinder 11, has gripping or needle points 12′ located thereon which may permit collection of several sequentially cut sheets. A folding blade 12″ on the folding cylinder 12 can be projected radially outwardly to inject the printed substrate A1, that is, the substrates of the first type, into a folding gripper cylinder or folding flap cylinder 13. The combination of the cylinders 12, 13 thus makes a first transverse fold, either of a single sheet or a plurality of superimposed sheets—by sequential rotation of the cylinder 12 and forms the first transverse fold. The cylinder 13 is formed with suitable folding grooves or flaps 13′, having the customary gripping arrangement.

It is known that a second transverse fold can be made, e.g. by 13. a further folding knife or blade cylinder 14 which cooperates with cylinder 13. In accordance with a feature of the present invention, the second folding blade cylinder 14, which has suitable gripping points 14′, is used to apply to the printed substrates on the cylinder 13′ cut printed substrates A2 derived from the section 1*a*. To cut the substrates from the web 1*a*, it is only necessary to provide a further cutting knife cylinder 15, and to guide the web section 1*a* about the cylinder 14 in such a manner that the web section 1*a* is cut to the desired length. This has the advantageous result that it is now possible to utilize the second folding blade cylinder 14, known as such, in a different manner from that previously used, in that the printed substrates A2 of the second type from the web section 1*a* are pushed in the corresponding folding flaps 13′ of the folding flap cylinder 13. Thus, the web section 1*a* receives the second fold, forming the first transverse fold.

The substrates A1, A2 may be of different type, for example the substrate A1 may be advertising material for ladies' wear and the substrate printed goods of the type A2 advertising material for men's wear which, conjointly, are to be inserted into a daily newspaper. As shown in broken lines in FIG. 1, the folding flap cylinder 13 has two folding systems 113*a* and 113*b* with respectively three folding groove or flap arrangements, each including flaps 13′. These two systems can be located to be rotatable or slidable with respect to each other; alternatively, additional folding grippers can be secured on the cylinder 13 if the portions of the cylinder which grip the folded edges cannot be shifted over a sufficient distance with respect to each other. It is thus possible to place the folded printed substrates A1—with respect to the substrates A2—in slightly overlapping manner on the folding cylinder 13 and to transfer the so overlapping folded substrates A1 and A2 to a subsequent transport arrangement, in form of superimposed belts 17, 17′ between which the substrates A1 and A2 are transported for further handling.

In accordance with a feature of the invention, a transfer means, shown as a selecting switch 16 is located downstream of the transport system 17, 17′. Depending on the selected mode, (a) the respective substrates A1 and A2 can then be guided to a transport system formed by the belts 18, 18′ and by another transport system formed by belts 19, 20. The belts transport the respective folded substrates each to a further folding apparatus, for example a longitudinal folding apparatus 21, 22, respectively. Such longitudinal folding apparatus, shown schematically at 21, 22, are well known and, generally, include a pair of rollers, located next to each other, between which a reciprocating blade can be inserted when the substrate, to be folded, is received, for subsequent transport to further transport belts 21*a*, 22*a*, shown only schematically. The individual folded substrates are shown in FIG. 5.

In accordance with a feature of the invention, another mode of operation, mode (b) is possible; if it is desired, for example, to join the pre-folded substrates A1 and A2 as a common folded product is such a manner that one substrate surrounds the other from which, however, the inner one can be easily removed—see FIG. 3—it is easily possible to assemble the two substrates together so that they will be available at a further utilization station such that the folded edges will be in alignment. In accordance with a feature of the invention, and in advance of the utilization station which, for example, may form a third fold, one of the substrates is delayed with respect to the other in a collecting apparatus 50. As shown, the substrates A1 are delayed so that they can be associated with the subsequent substrate A2, and be supplied with accurate register of the leading edges of the substrates. The two printed substrates—which, themselves, may include a plurality of sheets—are then jointly supplied (see FIG. 4) as substrates A1, A2 to a third fold, preferably a longitudinal fold for common folding. The result will be a printed product as seen in FIG. 3. This has the substantial advantage that a single operating step only is necessary to introduce both printed substrate types A1 and A2 in a publication, for example a daily newspaper, in a single step.

A collection unit 50, as shown in FIG. 1, has an inner and outer belt 28, 29, respectively. Printed substrates A1, which are deflected by the controlled switch 16, are thus deflected over a detour path which is longer than the straight-forward path defined between belts 28 and 23, so that the substrates A1 will arrive at the end of the collection unit 50 with some delay. Thus, they can be placed on top of a printed substrate A2 with the leading edges in precise alignment. A further switch 16′ is provided, located in the upper region of the collection unit 50, which, selectively, moves the printed goods either between the belts 18, 18′ to the folding unit 21 or between belts 23, 28 back to the alignment position with the printed substrates A2. If the switch 16′ is set to direct the substrates A2 continue in a straight path to the utilization point which, as shown, is the third longitudinal folding apparatus 22. Setting the switch 16' and forming part of the transfer means to direct the folded products A1 upwardly will result in operation in mode (a) with substrates as shown in FIG. 5, that is, two separate folded products at the output of the folding positions 21, 22.

Various deflection and guide rollers for the transport belts are shown in the drawings; they have not been given reference numerals and can be placed as desired; since their use is conventional, and their placement a mere matter of design, no further description thereof is deemed necessary. In a preferred form, at least one of the deflection rollers is located on a movable or shiftable shaft so that the length of the bypass or detour path for the substrates A1, if they are to be returned above the substrates A2, can be made adjustable to provide for precise alignment. Suitable tensioning rollers, then placed for example on the return runs of the respective belts, likewise have been omitted from the drawings since their placement and use are conventional.

Figure 2:
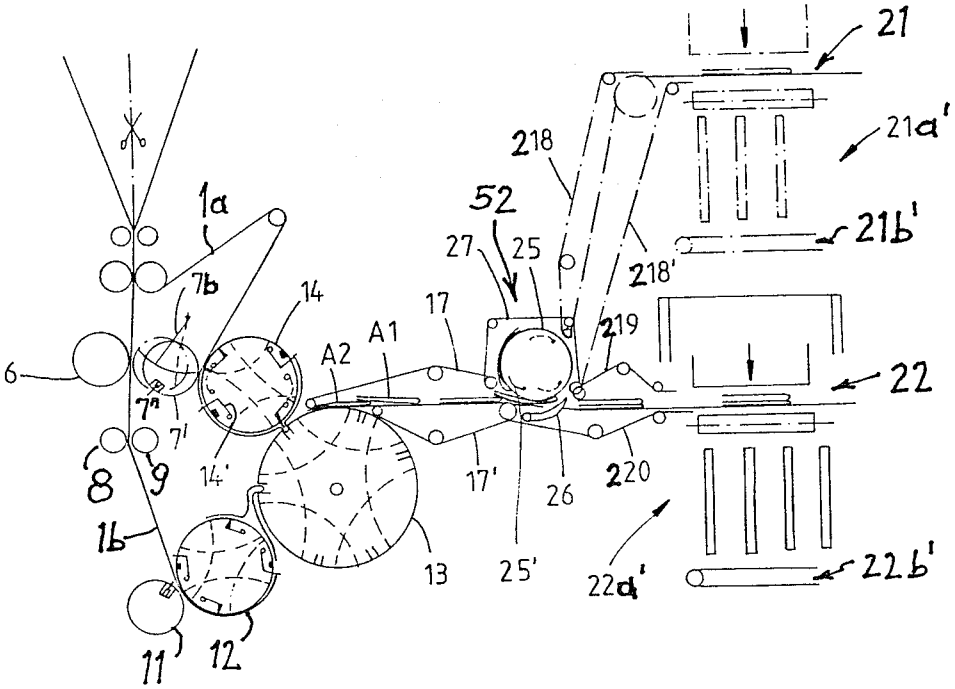
FIG. 2 illustrates another embodiment in which the collecting station is differently formed.

FIG. 2 illustrates a different form of the invention; identical elements have received the same reference numerals as in FIG. 1. The perforating cylinder 7' is supported from a movable lever 7*b*, so that it can be applied, selectively, against the roller 6 or against the folding blade cylinder 14. This arrangement eliminates the necessity for additional knife cylinders, such as knife cylinder 15, FIG. 1. As seen in FIG. 2, cylinder 7' is then supplied with cutter knives 7" to function also as a cutter cylinder.

The major difference between the embodiments of FIGS. 1 and 2 is the form of the collection unit or collection apparatus. The collection apparatus 52 of FIG. 2 utilizes a cylinder 25 supplied with grippers 25'. The controlled switch 26 controls whether the printed substrates A1, A2 are selectively applied to the belt system 218, or to the belt system 219, 220. When transfer means the switch 26 is set to supply any one of the folded products to the belt systems 218, 218', the respective folded products are delivered to the subsequent longitudinal folding apparatus 21, for removal by belts 21*a*', 21*b*'; changing the switch places the two substrates above each other for delivery by the belt system 219, 220 to the longitudinal folding apparatus 22, and subsequent transport by transport system 22*a*', 22*b*'. Thus, any desired production output can be obtained, in dependence on whether the grippers 25' on the cylinder 25 grip one of the substrates, for example of the type A1, and carry the respective substrate once about the cylinder, under the guidance of a belt system 27, or if the substrates are to be delivered between the belt system 218, 218'. The belt 27 retains the substrates which have been gripped by the grippers on the circumference of the cylinder; the time taken for the substrate on the cylinder 25 should be that which is required by the next subsequent substrate A2 to reach the release point from the cylinder, so that the two substrates A1, A2 can then be transported by the belt system 219, 220 to the utilization station 22. This arrangement, again, permits transversely folded substrates of different types, that is, types A1 and A2, to be collected in a single apparatus in advance of further processing, for example to form a third fold therein by the folding apparatus 22; the substrates A1, A2 will be in alignment with their leading edges. This collection in advance of the third fold will then cause the two substrates A1, A2 to be folded, together, by the folding apparatus 22, longitudinally, so that the folded product of FIG. 3 again will result. Selectively, of course, it is also possible to remove the substrates, without subsequent folding, by a paddle wheel or the like, which is located in running direction subsequent to the folding apparatus 22, without operating the folding apparatus 22, thus obtaining two folded products 24, as shown in FIG. 4. If the printed substrates are folded in the longitudinal folder 22, the output 23 will be as shown in FIG. 3. Operating the switch 26 for sequential separation of the substrates A1, A2 to the respective third folding apparatus 21, 22 will result in the output shown in FIG. 5.

Heretofore, obtaining production output as shown in FIG. 3 was possible only by utilizing two complete sets of folding apparatus and it was necessary to utilize manual or machine working steps for collection of folded products, or for further processing, which is avoided by the selective operating modes made possible by the system in accordance with the present invention.

FIG. 6 illustrates another embodiment of the apparatus. The apparatus utilizes the folding former or triangle 2, over which a web 601 is passed to provide a first longitudinal fold. The now once longitudinally folded web 601 is pulled off the former by rollers 604 and rollers 605. The web 603 of half the original width, is perforated by a perforation cylinder pair 606, guided and pulled by a further pulling roller pair 70 and applied to a folding blade cylinder 608 The folding blade cylinder 608 cooperates with a cutter or knife cylinder 609 so that the web is cut to provide printed substrates of the desired length. The substrates of a first type A1 are picked up by needle points at the leading edge, by point or perforating elements 608' on the cylinder 608; suitable folding knives 608' push the substrates into suitable folding flaps or folding gripper grooves 610' of the adjacent folding cylinder 610. Cutter cylinders 609, folding knife cylinder 608 and folding flap or holding cylinder 610 form a first group or first assembly to provide the first transverse fold which follows the longitudinal fold over the former 2.

Transport belts 612, 613 receive the transversely folded substrates A1. In one operating mode, the transversely folded substrates A1 are applied, by direct guidance, to a longitudinal folding apparatus 614 to form a third fold, or the second longitudinal fold. The folding apparatus is constructed similarly to the folding apparatus 21, 22 (FIGS. 1, 2), namely including a pair of folding rollers 614*a*, between which a folding blade 614*b* can be engaged to push the substrates A1, A2 between the rollers 614*a*, for example centrally, as schematically illustrated by the arrow 614*c*. Rather than providing a longitudinal fold, a different type of fold, a different processing of course may occur at station 614.

The folding blade cylinder 116 functions also as a transfer cylinder; it cooperates with the folding flap or gripper cylinder 610 having grippers 611' and may form a second transverse fold in the group of subject matter on the cylinder 610, if this is desired.

In accordance with a feature of the invention, the folding blade cylinder 610 may operate in a selected mode, and for example in mode (a) in which the folded substrate A1 are lifted off the cylinder 610 by cylinder 611 and are supplied to the belt transport system 616, 617. From the belt transport system 616, 617, the substrates A1 reach a second processing apparatus 615, for example to form a third fold, and which may be similar to the apparatus 614 described above. Preferably, again, a longitudinal fold is formed in the apparatus 615. Thus, the apparatus provides the versatility also present in the apparatus of FIGS. 1 and 2, namely to permit transversely folded substrates A1 to be supplied either directly to the third folding apparatus 614 or to the alternate third folding apparatus 615 or, in alternating sequence, in dependence on the operation of the grippers 11' on the cylinder 11, selectively, for example in alternation, to the folders 614 and 615.

In accordance with a feature of the invention, a second type of printed substrate A2 can be folded transversely by a first fold and supplied to the substrates A1. If this is desired, the former 2 is supplied with a cutter 618 which cuts the web 601 to form two partial webs or web sections 601*a*, 601*b*. The longitudinal cutter 618 may be a rotating knife or the like, cutting the web at the apex of the fold formed by the former 2. The web section 601*a* is then processed as described in connection with the folded web 3.

The web section 601*b* is guided by respective deflection and guide rollers 119, 120, which may be tension or pull-off rollers, to a folding knife cylinder 22 which cooperates with a cutter cylinder 621, carrying a cutter knife to cut the web section 601*b* to desired length, and to thereby form the printed substrates A2. The folding blade on the folding cylinder 622, which may be similar to the cylinder 608, applies printed products to a folding gripper cylinder 623, which may be similar to the cylinder 610, to provide the first transverse fold by folding blades projecting from cylinder 622 in timed operation with the rotation of the cylinder. If desired, a further folding blade cylinder 622*a* can be associated with the cylinder 623 to generate a further transverse fold; this is not necessary and, therefore, cylinder 623 is shown in chain-dotted representation. Thereafter, the transversely folded substrates A2 are delivered to transport a combined collection and transport unit 650 formed by belts 624, 625, and associated with the already once transversely folded substrates A1. The association is carried out in such a manner that the edges of the substrates A1, A2 coincide, preferably such that the leading edges coincide accurately. The now superimposed substrates A1, A2 can be processed in the folder 614, or directly supplied to another utilization station, for example via a paddle or distribution wheel, not shown and well known in the art of handling printed material. This is mode (b) operation, with cylinder 611 not transferring substrates. If the third fold is not carried out, the result will again be the product 24 shown in FIG. 4 or in FIG. 9. Alternately, the second longitudinal fold can be carried out by the folder 614, in common, so that the product 23, as shown in FIG. 3 or in FIG. 7, will result.

The product 23 shown in FIG. 3 or in FIG. 7, can be inserted in a single insertion step to form a frequently desired insert of different product subject matter which is loosely within each other, for introduction into a magazine, newspaper, periodical or the like, so that two different types of products can be inserted in one handling step, which is time-saving, efficient, and hence results in cost savings.

Alternatively, and in mode (a) operation the portion A1 can be applied separately to the third fold in the apparatus 615 and the product A2 to the third fold in the folding apparatus 614, resulting in two separately available double-folded printed products, see FIG. 5 or in FIG. 8.

It is not necessary that the portions 1*a* and 1*b* be derived from the same web 601 applied to a former 2. Rather, the webs can be separately supplied to separate formers 2 and 626; in such operation, a web 602 is applied to the former 626, which has its usual folding rollers, pull-off rollers and perforating rollers, similar to the system described in connection with the web 601, resulting then in a folded web 603*b*. The web 603*b* can be handled separately to form the insert or printed substrate assembly A2, or can be additionally associated with a portion or section of the web 601, cut from the web 601 to form the section 1*b*. Thus, the folded products A2 may be of multi-sheet form, and the folded product A1 only formed as a single folded sheet, or a double folded sheet, if the additional folding cylinder 611 is also used. The system, thus, further increases the versatility of output obtainable with a minimum of equipment and at maximum operating rates. For details regarding stages 50 (FIG. 1) and 52 (FIG. 2), reference is made to the above referenced application Ser. No. 892,712, filed July 31, 1986, KOBLER now U.S. Pat. No. 4,720,091.

We claim:

1. Folding apparatus for cutting and for transverse folding of two types of printed substrates (A1, A2) and selectively handling the respective types of cut, folded, printed substrates of the different types to feed them in selected modes of operation separately, in a mode (a) to separate receiving stations (21, 22; 615, 614), or in mode (b), to a common receiving station 921, 615 or 22, 614) comprising means (2, 3; 602, 618, 626) for providing two types of continuous printed webs (1*a*, 1*b*; 603*b*);

first cutting and folding means (11, 12, 13; 608, 609, 610, 611) located to receive a first type (1*a*) of printed web, cutting the web and folding the cut web transversely to form a first transversely folded, cut, printed substrate (A1);

second cutting and folding means (14, 15, 13; 14, 7', 13; 621, 622, 623) located to receive a second type (1*b*) of printed web, cutting the web and folding the cut web transversely to form a second transversely folded, cut, printed substrate (A2);

said first and said second cutting and folding means being arranged to supply the printed substrates in pairs with the respective first and second substrates (A1, A2) spaced from each other with respect to the direction of movement of the substrates;

a first transport system (17, 19, 612) positioned to receive printed substrates (A1) from the first cutting and folding means;

a second transport system (17, 18, 18', 612) positioned to receive printed substrates (A2) from said second cutting and folding means;

selectively operable substrate transfer means (16, 16', 26, 611) transferring in accordance with selected mode (a), substrates individually to the first and second transport systems, or selected mode (b), collectively to one (19) of said transport systems;

and alignment means (50, 52; 650) operative for aligning collected substrates upon selected operation of the transfer means in accordance with selected mode (b) for receiving the cut substrates (A1, A2) from the first and second cutting and folding means and controlling the relative movement of the cut and folded substrates of the two types (A1, A2) for delivery by the transport means to the receiving station (22, 614) with the folded edges thereof superimposed and in alignment.

2. The apparatus of claim 1, wherein said first and second receiving station comprises a further folding station 921, 21*a*; 22, 22*a*'; 614, 614*a*, 614*b*, 614*c*).

3. The apparatus of claim 1, wherein the alignment means comprise a collection unit (50, 52; 650) defining a first path for one of the printed substrates and a second path for the other of the printed substrates;

and the transfer means selectively direct the substrates of one type into one path and the substrates of the other type into the other path, the path lengths of said first and second paths being different and matched to the operating speed of the apparatus and the length of the substrates to place a substrate of one type (A1) over a substrate of the other type (A2) with the folding edges in alignment.

4. The apparatus of claim 3, wherein (FIG. 2) the collection unit comprises a rotating cylinder (25) having grippers (25') thereon to carry one type (A1) of the folded printed substrates about the cylinder, and release the substrate (A1) on the cylinder above a substrate of the other type (A2) being supplied by the transport system, with the edges of the substrates (A1, A2) in alignment.

5. The apparatus of claim 4, wherein the transport means supply the substrates of the first and second type (A1, A2) to the cylinder with the grippers (25) in partially overlapping or imbricated position.

6. The apparatus of claim 3, wherein the alignment means comprises a rotating cylinder (25) having deflection flaps (25') thereon, and a transport belt (27) partially looped about the cylinder for transporting printed substrates of a selected type about said cylinder.

7. The apparatus of claim 3, wherein (FIG. 1) the collection unit comprises a belt transport system (20, 29; 23, 28) forming two transport paths of different lengths;

and transfer means (16, 16') selectively direct the printed substrate of the different types into different paths, the path lengths being so matched to the spacing of the respective types of substrates (A1, A2) on said transport systems (17, 17') that, after the substrates of the different types have passed through the respective paths, the substrates will arrive at an exit from the collection unit with the edges thereof superimposed and in alignment.

8. The apparatus of claim 7, wherein the transport means supply the substrates of the first and second type (A1, A2) to the belt transport system in partially overlapping or imbricated position.

9. The apparatus of claim 1, wherein the web is supplied to a folding former (2), a cutter (3, 618) is provided for longitudinally cutting the web into two web sections (1*a*, 1*b*);

said apparatus further including a folding blade cylinder (14) including gripping points or needles (14'), and a cutting cylinder (15) associated therewith, one web section (1*a*) being supplied to said folding blade cylinder and cutting cylinder;

a further folding blade cylinder (12) having gripping points or needles (12') thereon and an associated cutting blade cylinder (11) is provided, said further folding blade cylinder (12) and cutting cylinder (11) receiving a second cut web section or portion (1*b*), and a single folding flap cylinder (13) is provided receiving the cut and folded substrates of different types (A1, A2) derived from the separate web portions or sections (1*a*, 1*b*), said folding flap cylinder delivering the folded substrates of both said types (A1, A2) to said transport means (17, 17'), said folding blade cylinders and cutting cylinders and said folding flap cylinder forming, respectively, said first and second cutting and folding means, said folding flap cylinder being common to both said first and second cutting and folding means.

10. The apparatus of claim 9, wherein said common folding flap cylinder (13) supplies the folded substrates of said first and second type (A1, A2) in overlapping form and in pairs to said transport means (17, 17').

11. The apparatus of claim 9, wherein (FIG. 2) the cutting blade cylinder associated with the folding blade cylinder (14) comprises a perforating and cutting cylinder of a perforating cylinder pair (6, 7'); and movable between engagement with a perforating counter cylinder (6) or said folding blade cylinder (14).

12. The apparatus of claim 1, wherein two alignment means are provided, one each located in the path to a respective receiving station;

and wherein said receiving stations comprise further folding means.

13. The apparatus of claim 1, wherein (FIG. 6) said transport systems comprise at least two transport belt sections (612, 613; 624, 625) receiving the cut, printed substrates of the respective types (A1, A2) from said first cutting and folding means and said second cutting and folding means, respectively, said transport belt sections having respective path lengths to form said alignment means (650) to deliver the cut and folded substrates of said two types with the folded edges thereof superimposed and in alignment when the transfer means is operated in mode (b).

14. The apparatus of claim 1, wherein said first cutting and folding means (608, 609, 610, 611) forms a first folding and cutting subassbely, for folding a substrate of a first type; said second cutting and folding means forms a second cutting and folding subassbemly (621, 622, 623), for folding a substrate of the second type;

said transport system comprises two transport belt systems (612, 613; 624, 625) located to remove the respective substrates from said first and second cutting and folding subassemblies, respectively, for supply thereof, with the edges in alignment, to the receiving station;

and a folding former (2) is provided receiving a web and cutting said web, upon folding, into two web sections (601*a*, 601*b*) one web section being supplied to one cutting and folding subassembly and the other web section being supplied to the other cutting and folding subassembly.

15. The apparatus of claim 14, wherein the first folding subassembly comprises a folding blade cylinder (611) having grippers (611') selectively permitting forming of a further transverse fold in the folded substrate (A1) being supplied thereto, or supplying said printed substrate to the respective transport system (612, 616, 617).

16. The apparatus of claim 1, wherein (FIG. 6) two folding formers (2, 626) are provided, each supplying a folded web of a respective type (603*a*, 603*b*) to the respective first cutting and folding means (608, 609, 610, 611) and the second cutting and folding means (621, 622, 623).

17. Folding apparatus for cutting and for transverse folding of two types of printed substrates (A1, A2) and selectively handling the repective types of cut, folded, printed substrates of the different types to feed them selectively to two individual receiving statios (21, 22; 615, 614), comprising means (2, 3; 602, 626) for providing two types of continuous printed webs (1*a*, 1*b*; 603*b*);

first cutting and folding means (11, 12, 13; 608, 609, 610, 611) located to receive a first type (1*a*) of printed web, cutting the web and folding the cut web transversely to form a first transversely folded, cut, printed substrate (A1);

second cutting and folding means (14, 15, 13; 14, 7', 13; 621, 622, 623) located to receive a second type (1*b*) of printed web, cutting the web and folding the cut web transversely to form a second transversely folded, cut, printed substrate (A2);

transport means (17, 611, 612) for removing the cut, printed substrates (A1, A2) from the respective first and second cutting and folding means, said first and said second cutting and folding means being arranged to supply the printed substrates to the transport means in pairs with the respective first and second substrates (A1, A2) spaced from each other with respect to the direction of movement of the transport system;

a first transport system (17, 19, 612) positioned to deliver printed substrates (A1) to the one (21, 615) of the receiving stations;

a second transport system (18, 612) positioned to deliver printed substrates (A2) to the other (22, 614) receiving station; and selectively operable substrate transfer means (16, 16', 26, 611) positioned for transferring selected substrates from said transport means individually and selectively to the first and second transport systems for further transport of the selected substrates to the respective receiving stations.

18. The apparatus of claim 17, wherein the transfer means selectively direct the printed substrates of the different types (A1, A2) into different paths, the path lengths being so matched to the spacing of the respective types of substrates on said transport systems that, after the substrates of the different types have passed through the respective paths, the substrates will arrive at an exit from the transport systems with the edges thereof superimposed and in alignment.

19. The apparatus of claim 17, wherein the first folding subassembly comprises a folding blade cylinder (611) having gripper (611') selectively permitting forming of a further transverse fold in the folded substrate (A1) being supplied thereto, or supplying said printed substrate to the transport means (612, 616, 617).

20. The apparatus of claim 17, wherein said first and second receiving station comprises a further folding station.

* * * * *